US009277320B1

(12) United States Patent
Hoskins

(10) Patent No.: US 9,277,320 B1
(45) Date of Patent: Mar. 1, 2016

(54) MANAGING AND USING HEADSET PROFILES FOR DIFFERENT HEADSETS

(71) Applicant: AMAZON TECHNOLOGIES, INC., Reno, NV (US)

(72) Inventor: Kevin R. Hoskins, Hollister, CA (US)

(73) Assignee: Amazon Technologies, Inc., Reno, NV (US)

( * ) Notice: Subject to any disclaimer, the term of this patent is extended or adjusted under 35 U.S.C. 154(b) by 428 days.

(21) Appl. No.: 13/625,579

(22) Filed: Sep. 24, 2012

(51) Int. Cl.
*H04R 5/033* (2006.01)

(52) U.S. Cl.
CPC ..... *H04R 5/033* (2013.01)

(58) Field of Classification Search
CPC ... H04R 5/033; H04R 1/1041; H04M 1/6058; H04M 3/42161; H04M 1/05
See application file for complete search history.

(56) References Cited

U.S. PATENT DOCUMENTS 8,290,537 B2 * 10/2012 Lee et al. ..... 455/556.1
2006/0245598 A1 * 11/2006 Batai ..... 381/74
2007/0223721 A1 * 9/2007 Stern et al. ..... 381/74
2008/0242378 A1 * 10/2008 Lowles et al. ..... 455/575.2
2009/0117945 A1 * 5/2009 Mahler et al. ..... 455/569.1
2009/0179789 A1 * 7/2009 Haughay et al. ..... 341/176
2009/0180354 A1 * 7/2009 Sander et al. ..... 367/197
2009/0182913 A1 * 7/2009 Rosenblatt et al. ..... 710/72
2011/0263303 A1 * 10/2011 Lowles et al. ..... 455/575.2
2012/0014553 A1 * 1/2012 Bonanno ..... 381/364
2013/0044231 A1 * 2/2013 Chuang et al. ..... 348/211.4

OTHER PUBLICATIONS

Onairda, Headset Button Controller Trial, Released Date Aug. 30, 2011, www. m.onairda.store.aptoide.com, pp. 1-3.*
Soft112.com, Headset Button Controller, Released Date Aug. 30, 2011, www.headset-button-cntroller.soft112.com, pp. 1-2.*

* cited by examiner

*Primary Examiner* — Fan Tsang
*Assistant Examiner* — Angelica M McKinney
(74) *Attorney, Agent, or Firm* — Lowenstein Sandler LLP

(57) ABSTRACT

A user device prompts a user to provide button input to use for causing the user device or an application on a user device to perform a function. The user device associates the button input with the function and store the association in a headset profile. When the button input is later received from the headset, the user device accesses the headset profile and identifies the function associated with the button input. The user device performs the identified function.

25 Claims, 8 Drawing Sheets

MANAGING AND USING HEADSET PROFILES FOR DIFFERENT HEADSETS

BACKGROUND

A large and growing population of users enjoys entertainment through the consumption of media items, including electronic media, such as electronic books (also referred to herein as ebooks), electronic newspapers, electronic magazines and other electronic reading material, digital music, and digital video. Users employ various electronic devices to consume such publications. Among these electronic devices (e.g., user devices) are electronic book readers, cellular telephones, personal digital assistants (PDAs), smart phones, portable media players, tablet computers, electronic pads, netbooks, desktop computers, notebook computers and the like.

Users often use headsets in conjunction with the electronic devices (e.g., user devices such as smart phones, table computers, electronic book readers, etc.). The headsets may allow users to hear audio data (e.g., music, speech or voice, etc.) from the electronic devices or may allow users to provide audio data (e.g., speech or voice) to the electronic devices. For example, a user may use a headset to listen to a digital music file on a smart phone. In another example, a user may use a headset to speak with another person during a voice call. The headsets often include input mechanisms such as buttons (e.g., mechanical buttons or touch screen buttons), inline controls, slide bars, and control wheels, etc., that users may use to control the electronic devices. For example, the user may use a button on the headset to increase the volume or decrease the volume of a voice call.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
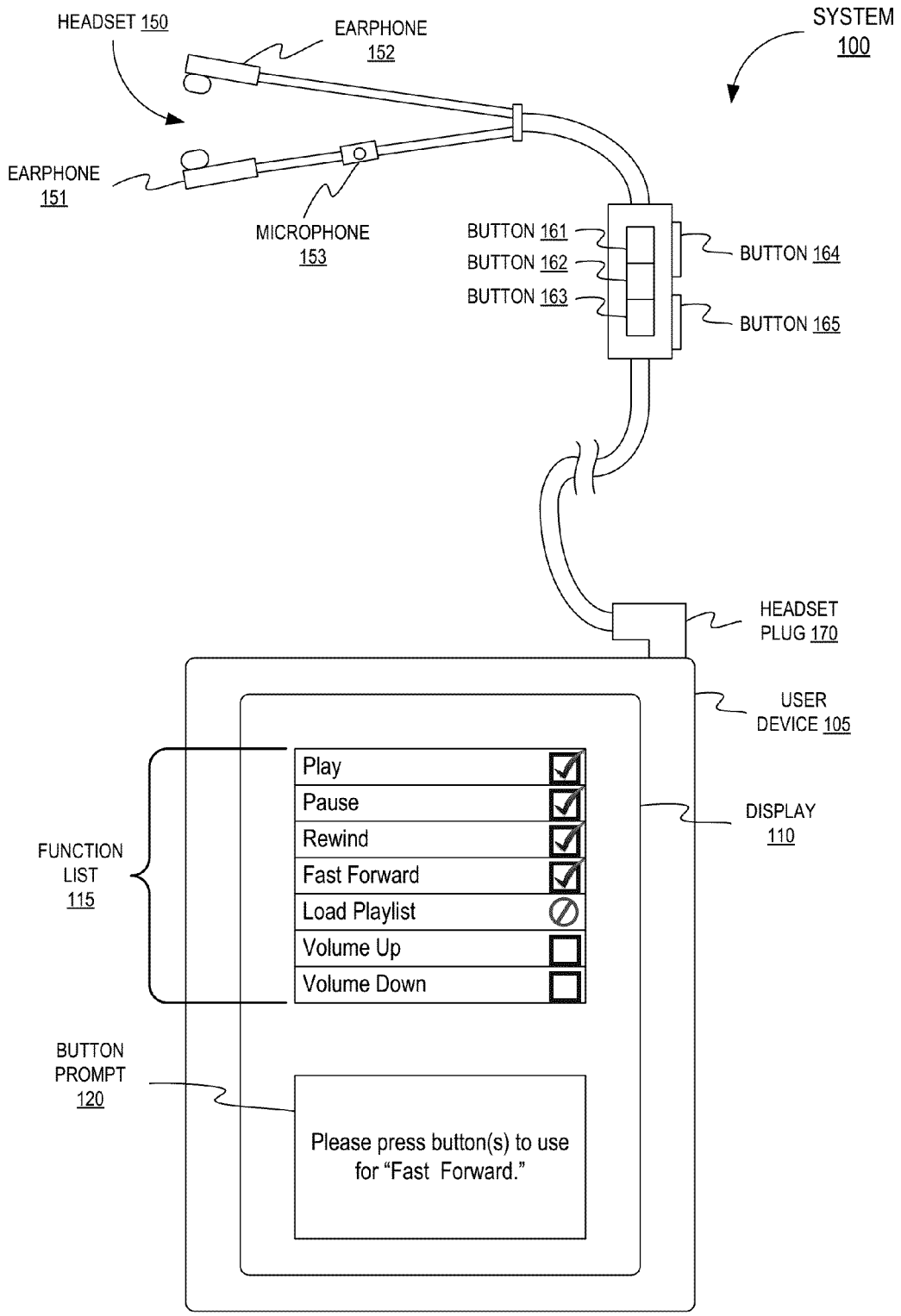
FIG. 1 is a diagram illustrating a first exemplary system in which embodiments of the disclosure may operate.

A user may use input mechanisms (such as buttons) on a headset to control a user device. An input mechanism may be any type of component, module, switch, button, slide bar, inline control, control wheel, and/or interface that allows a user to provide user input. However, not all headsets may be compatible with a particular user device. Different headsets may be manufactured or sold by different manufactures and each of the headsets may transmit or provide different input and/or button input (e.g., data indicative of one or more button presses, such as a signal, a voltage, a message, etc., data indicative of other input received via the input mechanisms) to the user devices when the buttons on the headsets are pressed. For example, a first headset may provide a first voltage to a user device (using an electrical contact on a 3.5 mm plug) when a "volume up" button on the first headset is pressed. A second headset may provide a second, different voltage to the user device when the "volume up" button the second headset is pressed. Thus, the user device may not recognize the voltage value provided by the second headset and the user device may not increase the volume when the button on the second headset is pressed. In addition, certain types of headsets (e.g., Bluetooth headsets) may use a standardized message indicating that a specific operation or function should be performed when certain buttons are pressed. User devices that use headsets (that use standardized messages such as Bluetooth protocol messages) may perform the specific operation when a button is pressed and may not allow a user to specify another operation to perform.

Systems and methods in accordance with various embodiments of the present disclosure provide the ability to map or associate the different types of inputs and/or button inputs provided by different headsets, to control functions (e.g., volume up, volume down, play, pause, etc.) that may be performed by the user device. The user device may perform a setup operation that presents or displays a series of prompts to the user. Each prompt may request the user to provide an input and/or a button input (e.g., data indicative of one or more button presses) to associate with a particular control function. The user device may store these associations in a headset profile that may be associated with the headset or an application on the user device. When the user later connects the headset to the user device, and provides an input and/or a button input via one or more input mechanisms (e.g., buttons, slide bars, etc.) on the headset, the user device may identify the control function associated with the input and/or button input (using the headset profile) and may execute that control function. This may allow a user to use headsets from different manufactures. This may also allow a user to customize the buttons on a headset (e.g., to customize the control functions that will be performed when one or more buttons are pressed). For example, this may allow a user to specify that the user device should perform the "next track" command when the "call end" button on a Bluetooth headset if pressed.

FIG. 1 is a diagram illustrating a first exemplary system 100 in which embodiments of the disclosure may operate. The system 100 includes a headset 150 and a user device 105 (e.g., a smart phone, an electronic book reader, a tablet computer, etc.). The user device includes a display 110 (e.g., a liquid crystal display (LCD), a touch screen, an electrophoretic ink (e-ink) display, etc.). The headset 150 includes earphones 151 and 152, a microphone 153, buttons 161, 162, 163, 164, and 165, and a headset plug 170. The headset 150 may be coupled to the user device 105 via headset plug 170. In one embodiment, the headset 150 may be physically connected to the user device 105. The headset plug 170 may be a physical connector used to connect headset 150 to the user device 105. For example, the headset plug 170 may be a tip, ring, sleeve (TRS) such as 6.35 mm TRS connector, a 3.5 mm TRS connector, or a 2.5 mm TRS connector. The headset plug 170 may be coupled to a headset jack (e.g., a 3.5 mm headset jack) on the user device 105. In another example, the headset plug 170 may be a universal serial bus (USB) connector. In further examples, the headset plug may be a FireWire connector, an external serial AT attachment (eSATA) connector, or any other physical connector or connection port. The user device 105 may also include different types of ports, jacks or connection interfaces to connect to the headset plug 170 of the headset 150.

The earphones 151 and 152 may provide sound or audio data to a user of the user device 105. For example, the user device 105 may have media playing capabilities or functions (e.g., the user device 105 may be able to play a digital music file or a digital video file). The earphones 151 and 152 may allow a user to listen media that is played by the user device 105. Although the headset 150 includes two ear phones 151 and 152 (e.g., a left earphone and a right earphone), the headset 150 may only have one earphone in other embodiments. In addition, the earphones 151 and 152 may be any type of earphones or headphones, including, but not limited to, earbuds, in-ear headphones, over-ear headphones, etc. The microphone 153 may provide sound or audio data to the user device 105. For example, the user device 105 may be a smart phone and the microphone 153 may capture audio data (such as the user's voice) and provide the audio data to the user device 105 (e.g., the user may use the microphone 153 to speak to a different person in a voice call). Although the headset 150 includes one microphone 153, in other embodiments, the headset 150 may include multiple microphones. For example, the headset 150 may include two microphones for noise cancelling functions or to enhance the audio data received by the microphones.

In one embodiment, the buttons 161, 162, 163, 164, and 165 may provide input, such as button input (e.g., data indicative of button presses, signals, messages, voltages, or other data) to the user device 105. Button input may refer to any data, signal, message, or voltage that is provided by a headset when one or more buttons on the headset are pressed. Input may refer to any data, signal, message, or voltage that is provided by a headset when one or more input mechanisms (e.g., one or more buttons, slide bars, control wheels, etc.) on the headset are pressed. For example, a Bluetooth headset may transmit a message (e.g., a Bluetooth protocol message) to a user device when one or more buttons on the Bluetooth headset are pressed. In another example, a headset that is connected to a user device via a physical plug (e.g., such as a 3.5 mm plug) may provide a specific voltage to the user device via an electrical contact (e.g., the microphone contact ring) when one or more buttons on the headset are pressed. The button input may indicate that one button was pressed, that a sequence of buttons was pressed (e.g., one button was pressed twice within a certain time frame, two different buttons were pressed within the certain time frame), that a button was pressed or held for a period or duration of time (e.g., a button was held down for a duration of 5 seconds), or that multiple buttons were pressed simultaneously (e.g., two buttons were pressed simultaneously).

The button input may cause the user device 105 to perform different control functions. For example, when the user presses button 162, the headset 150 may send button input (e.g., data indicative of button presses, a signal, a voltage, a message, etc.) to the user device 105 and the user device 105 may terminate or end a voice call based on the button input. In another example, when the user presses button 164, the headset 150 may send button input (e.g., data indicative of button presses, a signal, a voltage, a message, etc.) to the user device 105 and the user device 105 may increase the volume for a media player application, based on the button input. A control function may be any operation, method, or function that may be performed by a user device. In one embodiment, a control function may be performed by an operating system of the user device 105. In another embodiment, a control function may be performed by an application executing on the user device 105. Examples of control functions include, but are not limited to, increasing a volume, decreasing the volume, playing a media item, pausing playback of a media item, skipping to a next media item, going back to a previous media item, rewinding a media item, fast forwarding a media item, answering a call, ending a call, loading a play list of media items, loading a contact list (e.g., a list of phone numbers or emails), etc.

Although the buttons 161 through 165 may be used to provide button input to user devices, not all user devices are able recognize or are able to process the button input provided by the headset 150. For example, if the headset plug 170 is a 3.5 mm connector, the headset 150 may apply different voltages on an electrical contact on the 3.5 mm connector when different buttons are pressed. The different voltages may be received by the user device 105 via the headset jack (e.g., the 3.5 mm headset jack) on the user device 105. However, different headset manufacturers or vendors may use different voltages. For example, a first headset manufacturer may use a first voltage to indicate that a "volume up" button has been pressed, but a second headset manufacturer may use a second, different voltage to indicate that a "volume up" button has been pressed. Thus, a traditional user device may be able to process the button input (e.g., data indicative of button presses, messages, signals, voltages, etc.) received from one headset, but may not be able to process the button input received from another headset.

In one embodiment, the user device 105 may perform a setup operation when the headset 150 is connected to the user device 105. The setup operation may be performed to allow a user to associate one or more buttons on the headset 150 with control functions on the user device 105. For example, the setup operation may allow a user to specify what control functions the user device 105 should perform when a button (e.g., button 161) on the headset 150 is pressed. In one embodiment, the user may initiate the setup operation manually. In another embodiment, the user device 105 may being the setup operation automatically when the user device 105 detects that the headset 150 is connected to the user device 105.

The user device 105 may identify one or more control functions (e.g., one or more operations or functions) that may be performed by the user device. For example, the user device may identify "volume up," "volume down," "play," and "pause" functions. In one embodiment, the control functions may be identified based on an application executing on the user device 105. For example, the user device 105 may determine the type of the application executing on the user device (e.g., a media player, a call manager, a game, a web browser, a news application, a social networking application, etc.). The user device 105 may identify the control functions based on the type of the application. For example, if a media player type application is executing on the user device 105, the user device 105 may identify "volume up," "volume down," "play," "pause," "rewind," and "fast forward" functions. In another example, if a call manager type application (e.g., an application that controls phone calls) is executing on the device, the user device 105 may identify "volume up," "volume down," "answer call," and "end call" functions. The user device 105 may also identify functions based on the name of the application. For example, if the application is named "MP3Player" the user device 105 may identify typical media player functions (e.g., stop, pause, play, etc.). In another example, if the application is named "CallManager," the user device 105 may identify typical call function (e.g., answer call, end call, volume up, volume down, hold, mute, etc.). In another embodiment, the user device may identify a default set control functions which are generally performed by different types of user devices. For example, the "volume up" and "volume down" functions may be default controls functions that may be performed by most types of user devices.

After identifying the control functions, the user device 105 may present or display a function list 115 on the display 110. The function list 115 may include a list of the control functions that are identified by the user device 105 (e.g., default control functions or control functions identified based on the type and/or the name of an application executing on the user device 105). The user device may iterate (e.g., go through) the control functions included in the function list 115. For each control function, the user device 105 may display a button prompt 120. The button prompt may request that the user press one or more buttons that the user wants to use in order to cause the user device 105 to perform a control function. For example, as shown in FIG. 1, the button prompt requests the user to push or press one or more of the buttons 161 through 165, to use for the "fast forward" control function. After the user pushes or presses one or more buttons (e.g., button 163) for each button prompt, the user device 105 may receive the button input (e.g., data indicative of a button press, a sequence of button presses, a duration of a button press, or simultaneous) from the headset 150 and may associate the button input with the control function (e.g., fast forward) indicated in the button prompt.

As the user presses one or more buttons (thereby providing button input for a particular control function), the function list 115 may provide a confirmation (e.g., a visual indicator or confirmation, an audible indicator or confirmation, etc.) indicating that the button input is associated (e.g., corresponds to, is mapped, is correlated) with the particular control function. For example, the user device may present a button prompt request the user to push one or more buttons to use for the "Play" control function. After the user presses button 162, the function list 115 may display a check box next to the "Play" control function to indicate that button input (e.g., the data indicative of one or more button presses, such as a voltage, etc.) resulting from pressing the button 162 is associated with (e.g., mapped to) the "Play" control function. Thus, the next time the user pushes button 162, the user device will perform the "Play" control function because the button input (e.g., the data indicative of one or more button presses, such as a signal, a message, a voltage, etc.) transmitted by the headset 150 when the user pushes button 162 is associated with the "Play" control function. The confirmation may be a visual confirmation, such as a check box, a string (e.g., the string "Confirmed" or "OK), an icon, an image, or some other visual indicator. The confirmation may also be an audible confirmation. For example, the user device may play a "ding" noise to indicate that a button input has been associated with a particular control function.

In one embodiment, the user may not provide button input (e.g., may not press any buttons) for a control function in the function list 115. For example, the user may not care about or may not want to use a control function in the function list 115. Thus, the user may not want a button input associated with the particular control function. The user may provide input indicating that no button input should be associated with the particular control function. For example, the user may use a keyboard, a touch screen, a separate button on the user device 105, etc., to indicate that the control function "Load Playlist" will not be used. In one embodiment, the user device 105 may display a visual confirmation (e.g., an icon, an image) such as a crossed circle in the function list 115, to confirm that that the user does not want to use the "Load Playlist" control function. In another embodiment, the user device 105 may also provide an audible confirmation (e.g., a "ding" noise).

The user device 105 may store these associations between button inputs and control functions in a headset profile (e.g., a table, a list, a file, a set of data blocks, etc.). The headset profile may be data that indicates one or more control functions and button inputs associated with the one or more control functions. For example, the headset profile may be a list of ten control functions and the button inputs associated with the ten control functions. The headset profile may be used by the user device 105 to determine which control function should be performed when a particular button input is received from the headset 150 (e.g., when the user pushes certain buttons on the headset 150). In one embodiment, the headset profile may be associated with a particular headset. For example, a user may have two different headsets (each with different buttons that produce different button input) and the user may create two different headset profiles, each headset profile associated with one of the two headsets. The user device 105 may perform a setup operation using the function list 115 and the button prompt 120 for each headset, to create the two headset profiles.

In one embodiment, the user device 105 may display a list of headset profiles and allow the user to select a particular headset profile to use for a headset. In another embodiment, the user device 105 may automatically detect that one of the headsets has been connected to the user device 105 and may select the headset profile associated with the headset. For example, a headset (e.g., a Bluetooth headset) may transmit an identifier or a medium access control (MAC) address. The user device 105 may store the identifier or MAC address in the headset profile associated with the headset so that when the headset connects to the user device 105, the user device can use the appropriate headset profile. In another example, the headset 150 may transmit two different voltages (e.g., button input) when a button (e.g., button 165) is pressed. The first voltage may be an identifier that allows the user device 105 to identify the headset 150 or the manufacturer of the headset 150. The second voltage may indicate which button on the headset 150 was pressed (e.g., button 165). The user device 105 may store the identifier in the headset profile associated with the headset 150 so that when the headset 150 connects to the user device 105, the user device can use the appropriate headset profile.

In one embodiment, the headset profiles may also be associated with an application (e.g., a program, a game, a media player, an app, etc.) on the user device 105. The headset profile associated with the application may be loaded or used by the user device 105, when the application is executing on the user device 105. For example, if a headset profile is associated with a media player application on the user device 105, the user device 105 may load or use the headset profile when the media player application is executing (e.g., running) on the user device 105. In one embodiment, the control functions in the headset profile may be control functions used or performed by the application associated with the headset profile. For example, a first headset profile associated with a media player application may include the "Play" and "Pause" control functions and a second headset profile associated with a call manager (e.g., an application used to manage voice calls) may include the "Answer Call" and "End Call" control functions.

Figure 2:
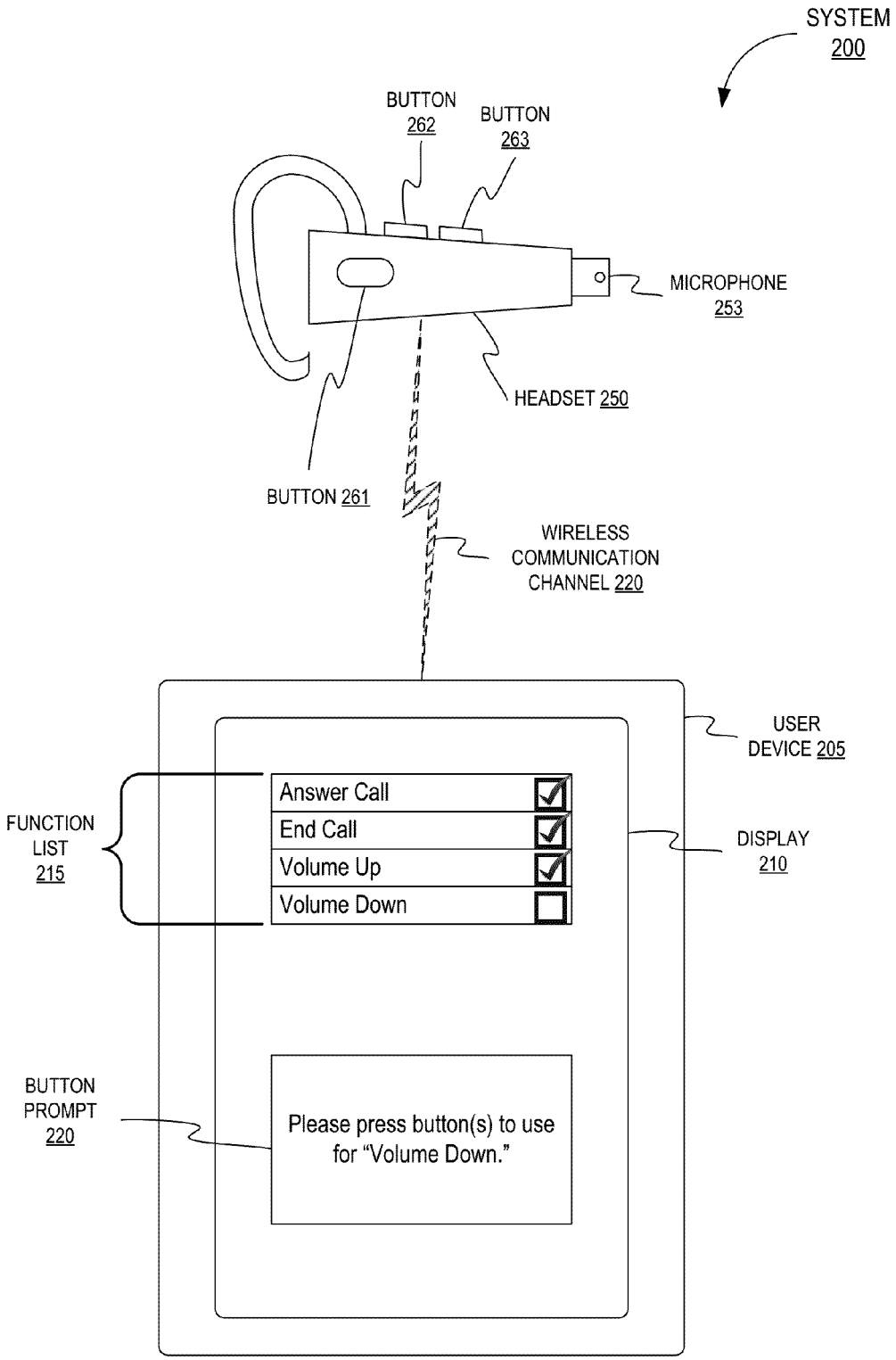
FIG. 2 is a diagram illustrating a second exemplary system in which embodiments of the disclosure may operate.

FIG. 2 is a diagram illustrating a second exemplary system 200 in which embodiments of the disclosure may operate.

The system 200 includes a headset 250 and a user device 205. The user device includes a display 210 (e.g., a liquid crystal display (LCD), a touch screen, an e-ink display, etc.). The headset 250 includes an earphone (not shown in the figure), a microphone 253, and buttons 261, 262, and 263. The headset 250 may be coupled to the user device 205 via a wireless communication channel 220. The headset 250 may communicate with the user device 205 using any number of communication protocols, including but not limited to, Bluetooth, ZigBee, Z-Wave, RuBee, 802.15, 802.11, transmission control protocol/internet protocol (TCP/IP), user datagram protocol (UDP), any wireless communication protocol, etc.

An earphone (not shown in FIG. 2) may provide sound or audio data to a user of the user device 205. For example, the earphone may allow a user to listen media that is played by the user device 205 or listen to a voice call. The microphone 253 may provide sound or audio data to the user device 205. For example, the microphone 253 may allow a user to speak to another person during a voice call. Although the headset 250 includes one microphone 253, in other embodiments, the headset 250 may include multiple microphones. In other embodiments, the headset 250 may be a wireless stereo headphone (e.g., Bluetooth headphones) that a user may use to listen to audio data (e.g., digital music) on the user device 205.

In one embodiment, the buttons 261, 262, and 263 may provide button input (e.g., data indicative of button presses, signals, messages, or other data) to the user device 205. In one embodiment, the button input may be standardized message that indicate that specific control functions should be performed by the user device 205 or an application on the user device 205, when the button input is received. However, as discussed above, a user may not want to user device to perform that specific control function when the standardized message is received from the headset. For example, the headset 250 may be a Bluetooth headset and when button 261 is pressed, the headset 250 may transmit a standardized message indicating that the user device should end a voice call. The user may want to use the button 261 to perform a different control function (e.g., load a media item playlist, load a contact list, play a digital media item, etc.).

In one embodiment, the user device 205 may perform a setup operation when the headset 250 is connected to the user device 205. The user device 205 may identify one or more control functions (e.g., one or more operations or functions) that may be performed by the user device when certain button inputs are received. In one embodiment, the control functions may be identified based on the type and/or the name of an application executing on the user device 205. In another embodiment, the user device may identify a default set control functions which are generally performed by different types of user devices. After identifying the control functions, the user device 205 may present or display a function list 215 that includes the list of control functions, on the display 210. The user device may iterate the control functions included in the function list 215. For each control function, the user device 205 may display a button prompt 220. The button prompt may request that the user press one or more buttons that the user wants to use in order to cause the user device 205 to perform a control function. After the user pushes or presses one or more buttons for each button prompt, the user device 205 may receive the button input and may associate the button input with the control function indicated in the button prompt.

As the user presses one or more buttons (thereby providing button input for a particular control function), the function list 215 may provide a confirmation (e.g., a visual confirmation such as an icon or checkbox, or an audible confirmation such as a "ding" noise) indicating that the button input is associated with the particular control function. In one embodiment, the user may not provide button input (e.g., may not press any buttons) for a control function in the function list 215. The user may provide input (via a touch screen or other input device) indicating that no button input should be associated with the particular control function. In one embodiment, the user device 205 may display a confirmation (e.g., a crossed circle icon or a "ding" noise) to confirm that that the user does not want to use a particular control function.

The user device 205 may store these associations between button inputs and control functions in a headset profile. The headset profile may be data that indicates one or more control functions and button inputs associated with the one or more control functions. The headset profile may be used by the user device 205 to determine which control function should be performed when a particular button input is received from the headset 250. In one embodiment, different headset profiles may be associated with different headsets. For example, a user may use multiple headsets with the user device 205. The user device 205 may perform a setup operation using the function list 215 and the button prompt 220 for each headset. In one embodiment, the user device 205 may automatically detect that one of multiple headsets has been connected to the user device 205 and may select the headset profile associated with the headset. In another embodiment, the user device 205 may display a list of headset profiles and allow the user to select a particular headset profile to use.

In one embodiment, the headset profiles may also be associated with an application on the user device 205. The headset profile associated with the application may be loaded or used by the user device, when the application is executing on the user device 205. In one embodiment, the control functions in the headset profile may be control functions used by the application associated with the headset profile.

Figure 8:
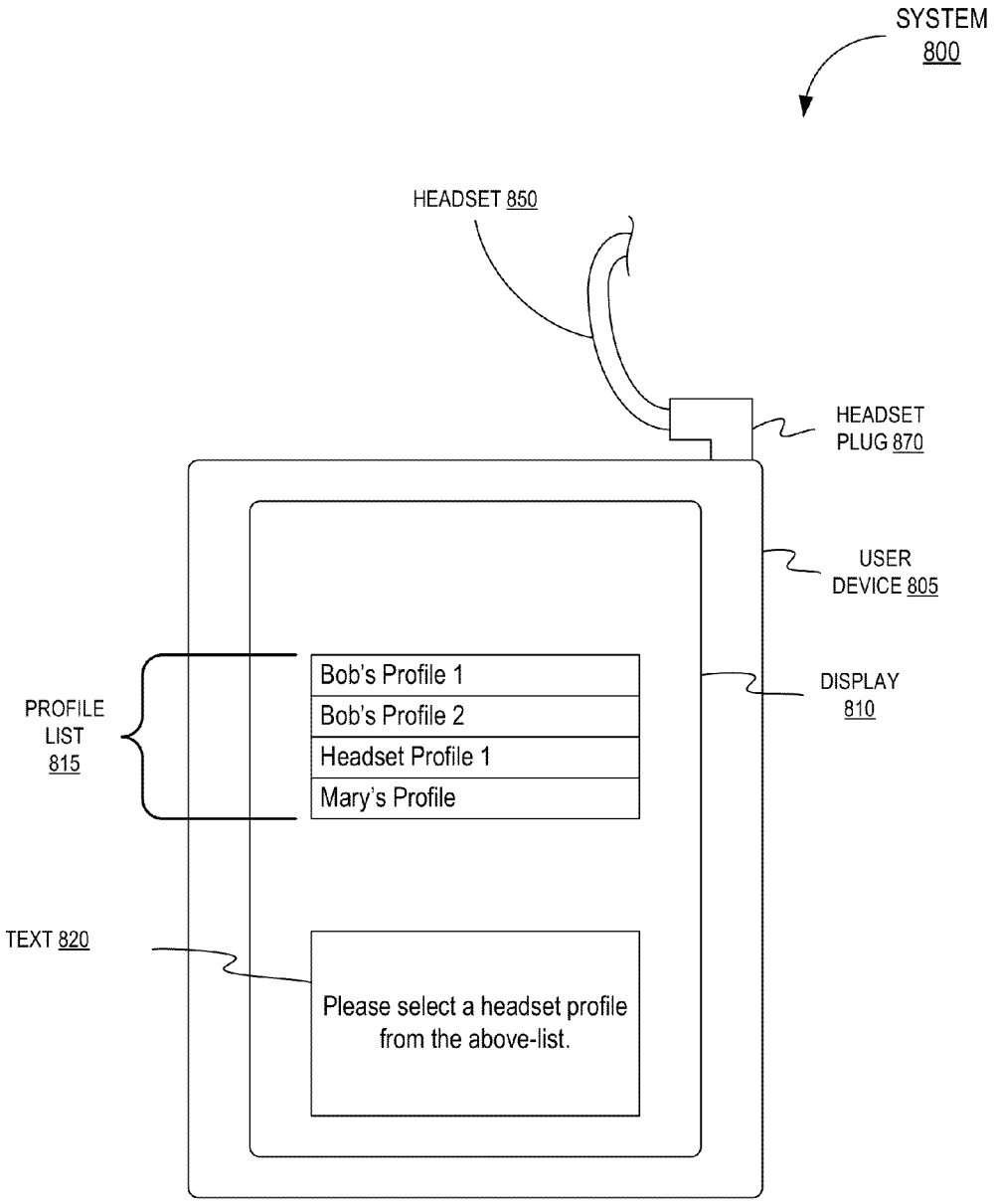
FIG. 8 is a diagram illustrating a third exemplary system in which embodiments of the disclosure may operate.

FIG. 8 is a diagram illustrating a third exemplary system 800 in which embodiments of the disclosure may operate. The system 800 includes a headset 850 and a user device 805 (e.g., a smart phone, an electronic book reader, a tablet computer, etc.). The user device includes a display 810 (e.g., a liquid crystal display (LCD), a touch screen, an electrophoretic ink (e-ink) display, etc.). The headset 850 may be coupled to the user device 805 via headset plug 870. For example, the headset 850 may be coupled to a 3.5 mm jack on the user device 805 via a 3.5 mm headset plug. In one embodiment, the headset 850 may be physically connected to the user device 805. The headset plug 870 may be a physical connector used to connect headset 850 to the user device 805.

In one embodiment, when the user device 805 detects that the headset 850 is connected to the user device 805, the user device 805 may present or display text 820 and profile list 815 on the display 810. The profile list 815 may be data indicative of one or more headset profiles (e.g., Bob's Profile 1, Mary's Profile, etc.) that are stored on the user device 805 or that the user device 805 has access to. For example, the profile list 815 may be a list of headset profiles that were previously created, or may be a list of headset profiles that the user device 805 may be able to download from another computing device (e.g., from a server computer). The text 820 may provide instructions to a user indicating that the user should select a headset profile from the profile list 815. In one embodiment, the user device 805 may display the profile list 815 without displaying the text 820. In other embodiments, various text, images, icons, videos, or other instructions may presented in place of the text 820. The user may provide user input (e.g., may tap or select a profile from the profile list 815) to indicate the selection of a particular headset profile.

Figure 3:
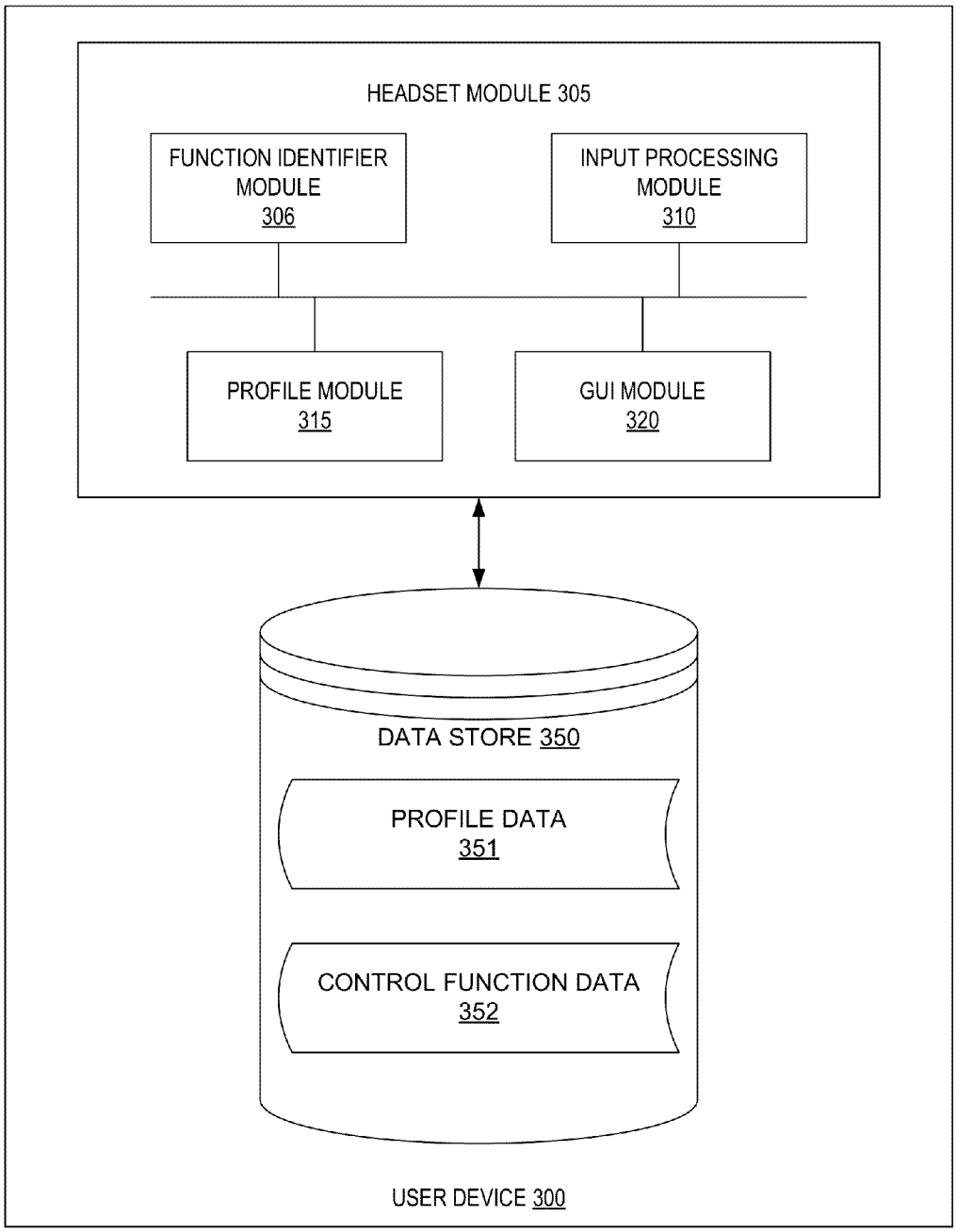
FIG. 3 is a block diagram illustrating an exemplary user device, according to one embodiment.

FIG. 3 is a block diagram illustrating an exemplary user device 300, according to one embodiment. The user device 300 includes a headset module 305 in communication with a data store 350. The data store 350 may be a file system, a database, a data storage device, a hard disk drive, a flash drive, random access memory (RAM), or any device or component capable of storing data. The data store 350 includes profile data 351 and control function data 352.

In one embodiment, the profile data 351 may include one or more headset profiles. In one embodiment, the headset profiles may be associated with an application on the user device 300 (e.g., one headset profile is associated with a media player application and another headset profile is associated with a call manager application). In another embodiment, the headset profiles may be associated with different headsets (e.g., one headset profile is associated with a first headset and a second headset file is associated with a second headset).

In one embodiment, the control function data 352 may include one or more lists of control functions. The lists of control functions may be associated with different applications on the user device 300. For example, one list of control functions may be associated with a media player application. The headset module 305 may use the lists of control functions to identify control functions to use during a setup operation (e.g., an operation to set up the user device to use a headset). In another embodiment, the control function data 352 may include a list of default control functions that may be performed by the user device 300 or by applications on the user device 300.

The headset module 305 includes a function identifier module 306, an input processing module 310, a profile module 315, and a graphical user interface (GUI) module 320. In one embodiment, the headset module 305 may perform a setup operation to allow a user to associate one or more buttons on a headset with one or more control functions on the user device 300.

In one embodiment, the function identifier module 306 may identify control functions (e.g., volume up, volume down, etc.) that may be performed by the user device 300 (e.g., performed by an operating system on the user device 300 or by an application executing on the user device 300). For example, if a media player application is executing on the user device 300, the function identifier module 306 may identify control functions that may be performed by the media player application (e.g., play, pause, next track, previous track, etc.). The function identifier module 306 may use the control function data 352 to identify control functions to use during a setup operation.

In one embodiment, the GUI module 320 may display a function list and one or more button prompts. For example, the GUI module 320 may display a function list and a button prompt as illustrated in FIGS. 1 and 2 (e.g., function lists 115 and 215, and button prompts 120 and 220). The function list may include functions identified by the function identifier module 306. The GUI module 320 may display confirmations (e.g., visual confirmations) to confirm that a button input has been associated with a control function, or to confirm that a user does not want to associate button input with the control function.

In one embodiment, the input processing module 310 may receive the button input provided by a user via a headset that is communicatively coupled (e.g., physically connected to or wirelessly connected to) the user device 300. For example, the input processing module may receive a message from the headset. In another example, the input processing module may receive a voltage or a signal received from the headset. In one embodiment, during a setup operation, the input processing module 310 may provide the button input to the profile module 315 so that the profile module 315 may associate a control function with the button input. In another embodiment, the input processing module 310 may provide the button input to the profile module 315 so that the profile module 315 may identify or determine a control function associated with the button input and perform the control function.

In one embodiment, the profile module 315 may associate button inputs with control functions. The profile module 315 may store the associations between the button inputs and control functions as headset profiles in the profile data 351. In another embodiment, the profile module 315 may also receive button input from a headset and may access a headset profile to identify or determine a control function that is associated with (e.g., corresponds to) the button input. The profile module 315 may cause the user device 300 or an application to perform the control function. In one embodiment, the profile module 315 may associate different headset profiles with different headsets. For example, the headset may transmit a MAC address or an identifier (e.g., a string, text, number, or other value or data) that identifies the particular headset. The profile module 315 may associate the headset profile for the particular headset with the particular headset by including the MAC address or identifier in the headset profile. In another embodiment, the profile module 315 may associate different headset profiles with different applications. This may allow a user to use different headset profiles (e.g., different mappings of button inputs to control functions) for different applications. The profile module 315 may associate an application with a headset profile by include an identifier (e.g., a name for the application, a type for the application) in the headset profile. In one embodiment, the profile module 315 may allow a user to name a headset profile so that the user can distinguish between the different headset profiles that are stored in the profile data 351. The profile module 315 may use the GUI module 320 to receive the name for the headset profile (e.g., the GUI module 320 may present an interface that allows a user to enter a name and may provide the name to the profile module 315).

Figure 4:
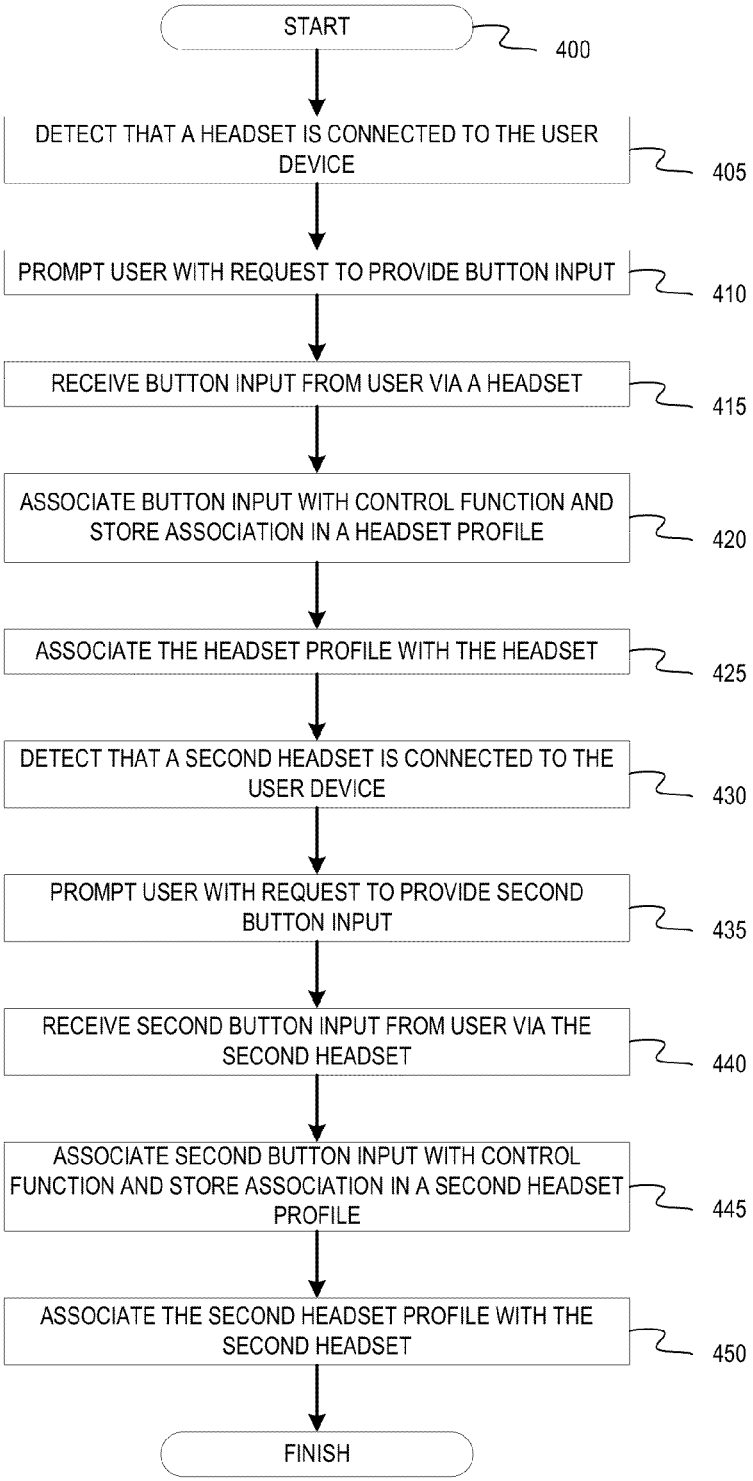
FIG. 4 is a flow diagram illustrating a method of processing button input received from a headset, according to one embodiment.
Figure 5:
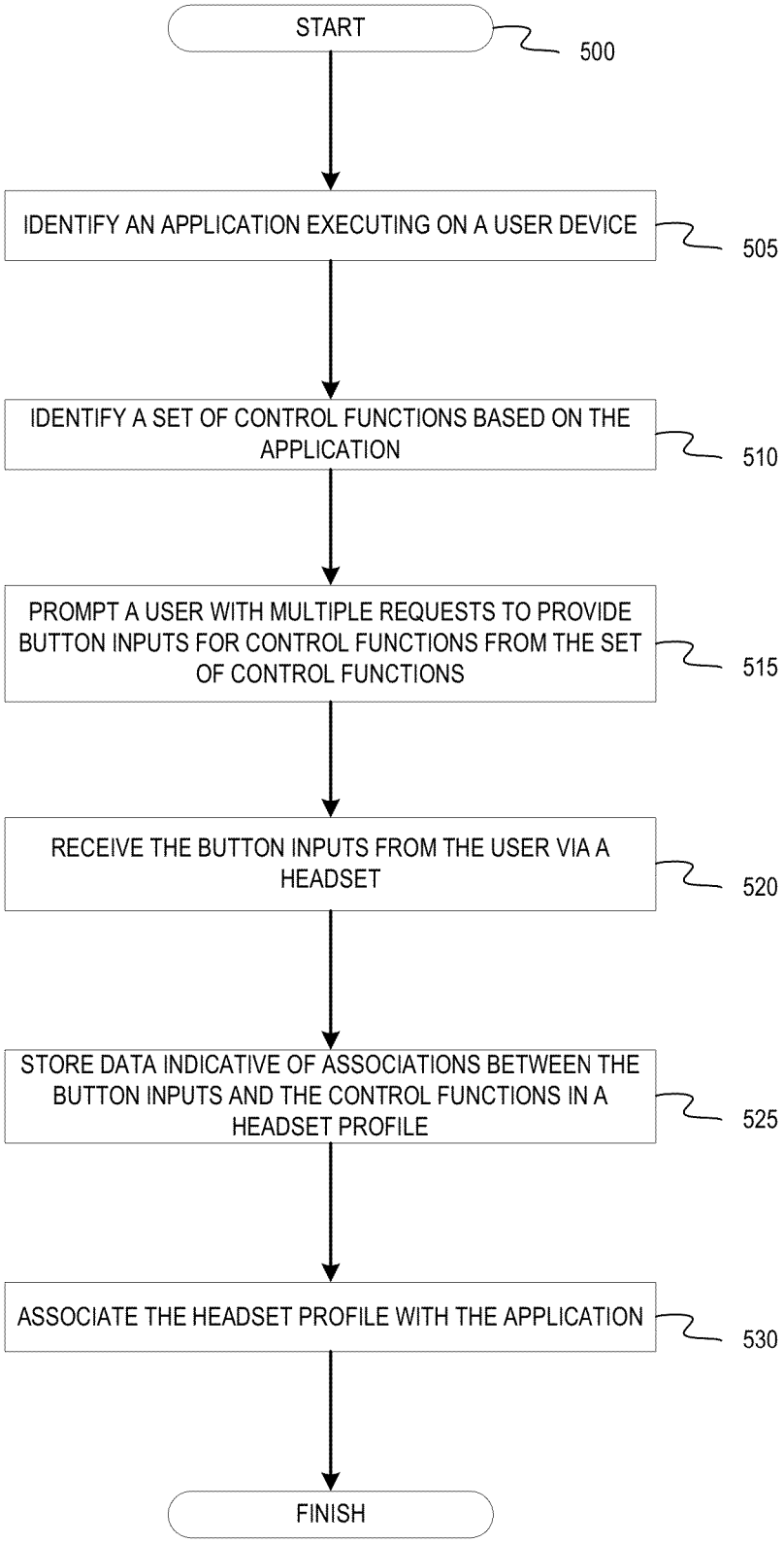
FIG. 5 is a flow diagram illustrating a method of processing button input received from a headset, according to another embodiment.
Figure 6:
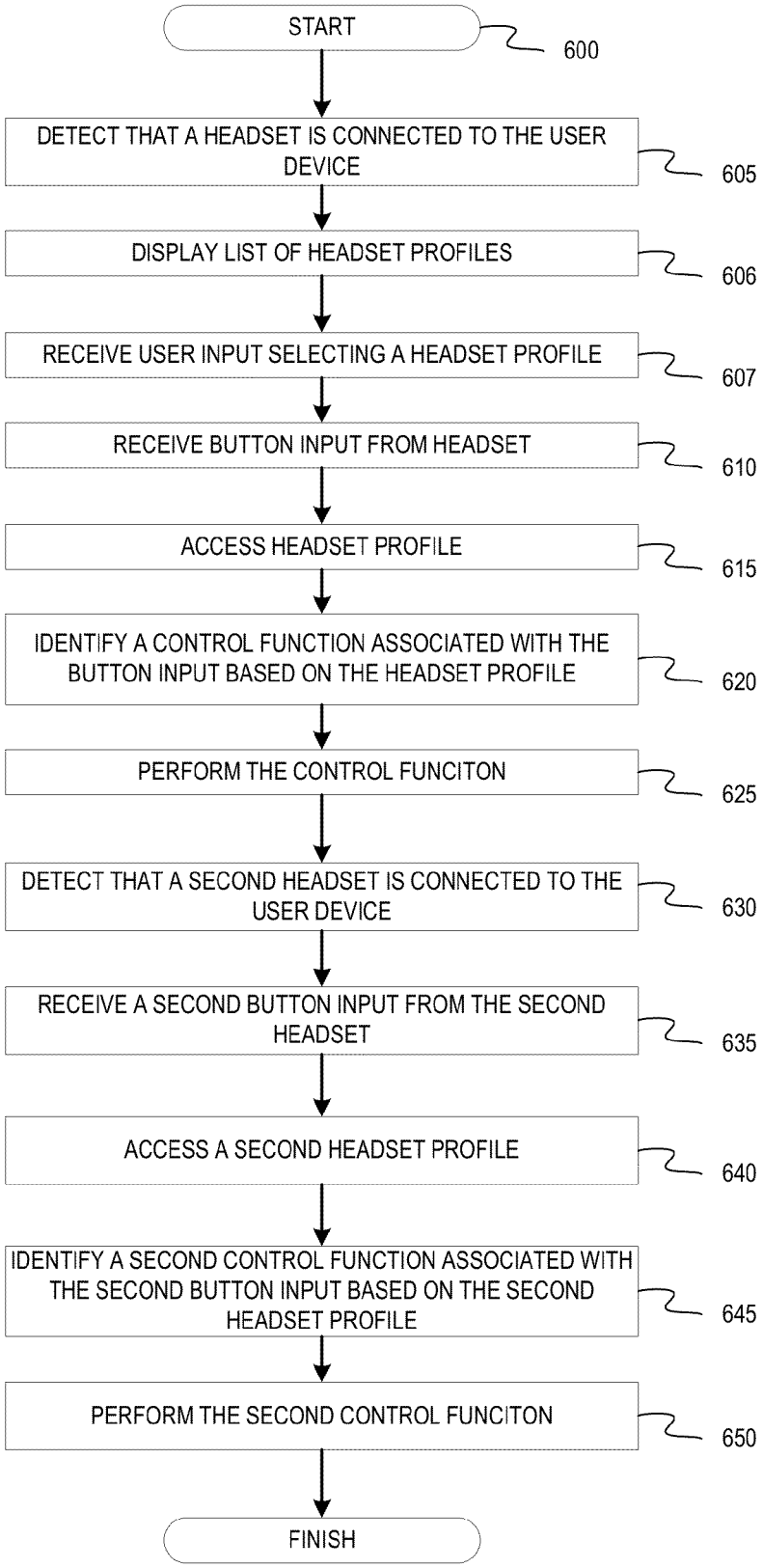
FIG. 6 is a flow diagram illustrating a method of processing button input received from a headset, according to another embodiment, according to a further embodiment.

FIGS. 4-6 are flow diagrams illustrating methods for processing button input received from a headset. For simplicity of explanation, the methods are depicted and described as a series of acts. However, acts in accordance with this disclosure can occur in various orders and/or concurrently and with other acts not presented and described herein. Furthermore, not all illustrated acts may be required to implement the methods in accordance with the disclosed subject matter. In addition, those skilled in the art will understand and appreciate that the methods could alternatively be represented as a series of interrelated states via a state diagram or events.

FIG. 4 is a flow diagram illustrating a method of processing button input received from a headset, according to one embodiment. The method 400 may be performed by processing logic that comprises hardware (e.g., circuitry, dedicated logic, programmable logic, microcode, etc.), software (e.g., instructions run on a processor to perform hardware simulation), or a combination thereof. The processing logic may be configured to perform a first setup operation for a first headset and a second setup operation for a second headset. In one embodiment, method 400 may be performed by a headset module, as shown in FIG. 3.

Referring to FIG. 4, the method 400 begins at block 405 where the method detects that a headset is connected to a user device (e.g., detects a physical connection or detects a wireless connection between the headset and the user device). At block 410, the method 400 prompts the user with a request (e.g., button prompt 120 shown in FIG. 1) to provide button input (e.g., prompts the user to push a button to provide data indicative of the button pushed, such as a signal, a message, a voltage, etc.) for a control function. The method 400 receives the button input from the user via the headset at block 415. At block 420, the method associates the button input with the control function, and stores the association between the button input and the control function in a headset profile (e.g., stores the association in a headset profile stored in the profile data 351 shown in FIG. 3). The method 400 associates the headset profile with the headset (block 425). For example, the method 400 may include data indicative of an identifier or a MAC address for the headset in the headset profile.

At block 430, the method 400 detects that a second headset is connected to the user device. The method 400 prompts the user with a request to provide a second button input (e.g., prompts the user to pressed one or more buttons) for the control function at block 435. The method 400 receives the second button input from the user via the second headset (block 440). At block 445, the method 400 associates the second button input with the control function and stores the association in a second headset profile. The method 400 associates the second headset profile with the second headset at block 450 (e.g., includes an identifier for the second headset in the second headset profile). After block 450, the method ends.

FIG. 5 is a flow diagram illustrating a method of processing button input received from a headset, according to another embodiment. The method 500 may be performed by processing logic that comprises hardware (e.g., circuitry, dedicated logic, programmable logic, microcode, etc.), software (e.g., instructions run on a processor to perform hardware simulation), or a combination thereof. The processing logic may be configured to perform a setup operation for a headset in communication with a user device. In one embodiment, method 500 may be performed by a headset module, as shown in FIG. 3.

Referring to FIG. 5, the method 500 begins at block 505 where the method identifies an application (e.g., a media player application, a call manager application) executing on a user device. For example, the method 500 may identify a name for the application (e.g., "MyApp") or may identify a type for the application (e.g., a media player type). At block 510, the method 500 identifies a set of control functions based on the identification of the application executing on the user device (e.g., identifies play, pause, next track, and previous track control functions, based on a media player application executing on the user device). At block 515, the method 500 prompts a user with multiple requests to provide button inputs (e.g., prompts the user to press one or more buttons to provide the button inputs) for control functions in the set of control functions. For example, the method 500 may display a function list and may display multiple button prompts, as illustrated in FIGS. 1 and 2.

At block 520, the method 500 receives the button inputs from the user via a headset coupled to the user device (e.g., via a Bluetooth headset, via a headset connected to the user device by a 3.5 mm plug). The method 500 stores data indicative of associations between the button inputs and the control functions in a headset profile at block 525. For example, the method 500 may store the associations between the button inputs and the control functions in a headset profile stored in profile data 351, as shown in FIG. 3. At block 530, the method 500 associates the headset profile with the application. For example, the method 500 may include the name of the application or an identifier for the application in the headset profile. After block 530, the method 500 ends.

FIG. 6 is a flow diagram illustrating a method of processing button input received from a headset, according to another embodiment, according to a further embodiment. The method 600 may be performed by processing logic that comprises hardware (e.g., circuitry, dedicated logic, programmable logic, microcode, etc.), software (e.g., instructions run on a processor to perform hardware simulation), or a combination thereof. The processing logic may be configured to receive button inputs and identify control functions for the user device to perform, based on the button input. In one embodiment, method 600 may be performed by a headset module, as shown in FIG. 3.

Referring to FIG. 6, the method 600 begins at block 605 where the method 600 detects that a headset is connected a user device. At block 606, the method 600 may display a list of one or more headset profiles to a user (e.g., display the list via a graphical user interface, as illustrate in FIG. 8). At block 607, the method 600 may receive user input selecting a headset profile from the list of one or more headset profiles. In one embodiment, blocks 606 and 607 may be optional. For example, the method 600 may automatically select a headset profile (e.g., select a headset profile based on an identifier for the headset) and may proceed to block 610. At block 610, the method 600 receives a button input (e.g., receives a signal or a message) from the headset. At block 615, the method 600 accesses the headset profile. In one embodiment, the headset profile may be the headset profile selected by the user at block 607. In another embodiment the headset profile may be a headset profile that is associated with the headset. For example, the method 600 may access the headset profile that includes an identifier for the headset. At block 620 the method 600 identifies a control function (e.g., volume up) associated with the button input, based on the headset profile. For example, the method 600 may access a table that indicates which control function is associated with the button input. The method 600 performs the control function at block 625 (e.g., increase the volume, pauses playback for a media item, etc.).

After performing the control function, the method 600 detects that a second headset is connected to the user device (block 630). At block 635, the method 600 receives a second button input (e.g., a second signal or second message) from the second headset. The method 600 access a second headset profile that is associated with the second headset at block 640. For example, the method 600 may access a second headset profile that includes a second identifier for the second headset. At block 645, the method 600 identifies a second control function associated with the second input based on the second headset profile. The method 600 performs the second control function at block 650. After block 650, the method 600 ends.

Figure 7:
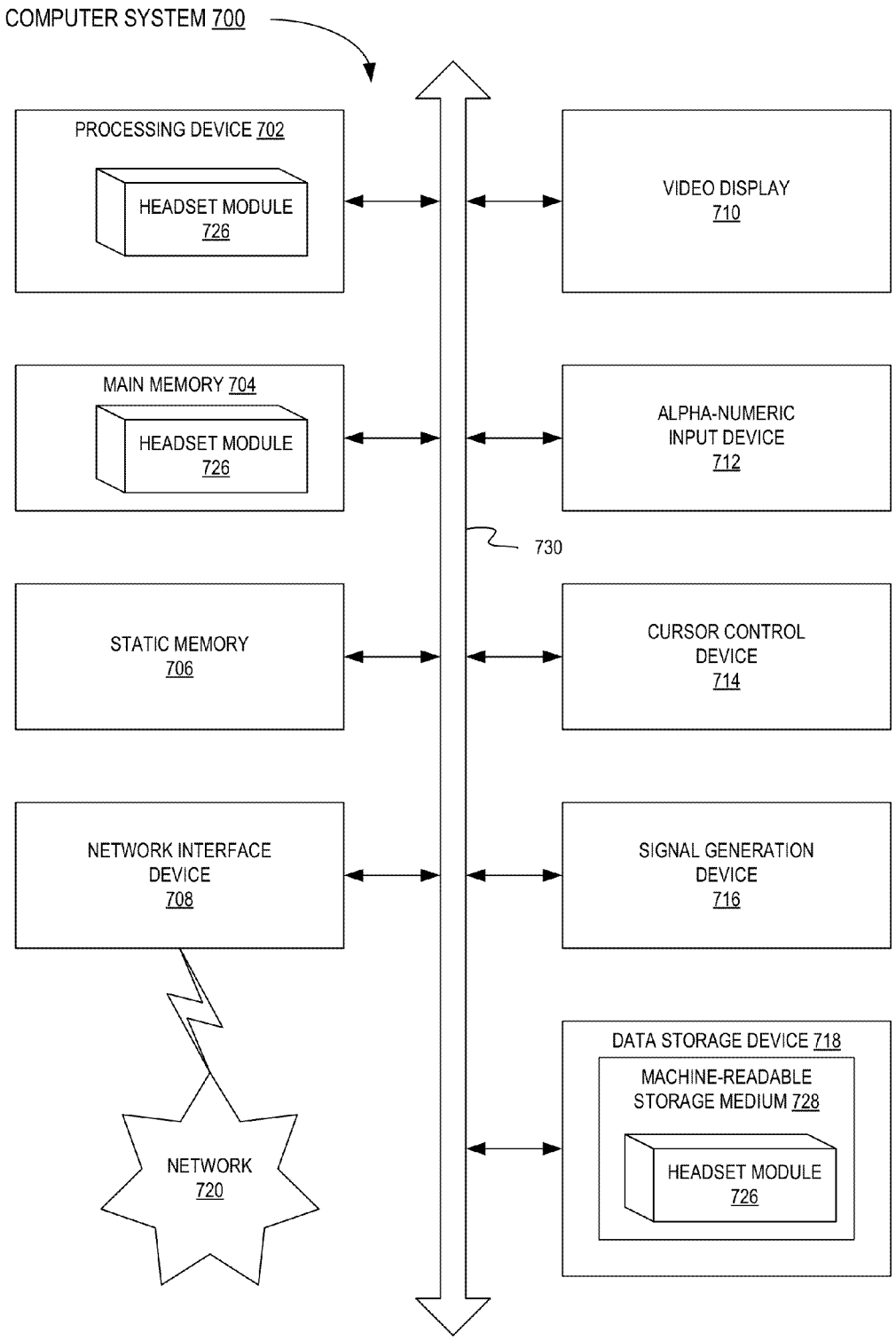
FIG. 7 is a block diagram of an exemplary network architecture, in which embodiments of the disclosure may operate.

FIG. 7 illustrates a diagrammatic representation of a machine in the exemplary form of a computer system 700 within which a set of instructions, for causing the machine to perform any one or more of the methodologies discussed herein, may be executed. The system 700 may be in the form of a computer system within which a set of instructions, for causing the machine to perform any one or more of the methodologies discussed herein, may be executed. In alternative embodiments, the machine may be connected (e.g., networked) to other machines in a LAN, an intranet, an extranet, or the Internet. The machine may operate in the capacity of a server machine in client-server network environment. The machine may be a personal computer (PC), a set-top box (STB), a server, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The exemplary computer system 700 includes a processing device (e.g., a processor) 702, a main memory 704 (e.g., read-only memory (ROM), flash memory, dynamic random access memory (DRAM) such as synchronous DRAM (SDRAM)), a static memory 706 (e.g., flash memory, static random access memory (SRAM)) and a data storage device 718, which communicate with each other via a bus 730.

Processing device 702 represents one or more general-purpose processing devices such as a microprocessor, central processing unit, or the like. More particularly, the processing device 702 may be a complex instruction set computing (CISC) microprocessor, reduced instruction set computing (RISC) microprocessor, very long instruction word (VLIW) microprocessor, or a processor implementing other instruction sets or processors implementing a combination of instruction sets. The processing device 702 may also be one or more special-purpose processing devices such as an application specific integrated circuit (ASIC), a field programmable gate array (FPGA), a digital signal processor (DSP), network processor, or the like. The processing device 702 is configured to execute headset module 726 for performing the operations and steps discussed herein.

The computer system 700 may further include a network interface device 708 which may communicate with a network 720. The computer system 700 also may include a video display unit 710 (e.g., a liquid crystal display (LCD) or a cathode ray tube (CRT)), an alphanumeric input device 712 (e.g., a keyboard), a cursor control device 714 (e.g., a mouse) and a signal generation device 716 (e.g., a speaker). In one embodiment, the video display unit 710, the alphanumeric input device 712, and the cursor control device 714 may be combined into a single component or device (e.g., an LCD touch screen).

The data storage device 718 may include a computer-readable medium 728 on which is stored one or more sets of instructions (e.g., instructions of headset module 726) embodying any one or more of the methodologies or functions described herein. The headset module 726 may also reside, completely or at least partially, within the main memory 704 and/or within the processing device 702 during execution thereof by the computer system 700, the main memory 704 and the processing device 702 also constituting computer-readable media. The instructions may further be transmitted or received over a network 720 via the network interface device 708.

While the computer-readable storage medium 728 is shown in an exemplary embodiment to be a single medium, the term "computer-readable storage medium" should be taken to include a single medium or multiple media (e.g., a centralized or distributed database and/or associated caches and servers) that store the one or more sets of instructions. The term "computer-readable storage medium" shall also be taken to include any medium that is capable of storing, encoding or carrying a set of instructions for execution by the machine and that cause the machine to perform any one or more of the methodologies of the present invention. The term "computer-readable storage medium" shall accordingly be taken to include, but not be limited to, solid-state memories, optical media and magnetic media.

In the above description, numerous details are set forth. It will be apparent, however, to one of ordinary skill in the art having the benefit of this disclosure, that embodiments of the invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "identifying," "determining," "detecting," "prompting," "receiving," "transmitting," "storing," "associating," "displaying," "obtaining," "providing," "accessing," "performing," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the invention also relate to an apparatus for performing the operations herein. This apparatus may be specially constructed for the required purposes, or it may comprise a general purpose computer selectively activated or reconfigured by a computer program stored in the computer. Such a computer program may be stored in a non-transitory computer readable storage medium, such as, but not limited to, any type of disk including floppy disks, optical disks, CD-ROMs and magnetic-optical disks, read-only memories (ROMs), random access memories (RAMs), EPROMs, EEPROMs, magnetic or optical cards, flash memory, or any type of media suitable for storing electronic instructions.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Moreover, use of the term "an embodiment" or "one embodiment" or "an implementation" or "one implementation" throughout is not intended to mean the same embodiment or implementation unless described as such.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

The above description sets forth numerous specific details such as examples of specific systems, components, methods and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth above are merely exemplary. Particular implementations may vary from these exemplary details and still be contemplated to be within the scope of the present invention.

It is to be understood that the above description is intended to be illustrative and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method comprising:

detecting, by a processing device, that a headset is connected to an electronic device, wherein the headset comprises a plurality of buttons;

identifying, by the processing device, a set of control functions performed by the electronic device;

presenting, by the processing device, a request for an input from one or more of the plurality of buttons of the headset, wherein the request asks for the input to be associated with performance of a control function from the set of control functions;

receiving, by the processing device, the input from the headset, wherein the input comprises data indicative of one or more of a single button press, a sequence of button presses, a duration of a button press, or simultaneous button presses;

associating, by the processing device, the input with the control function; and storing, by the processing device in a headset profile, data indicative of the association between the input and the control function.

2. The method of claim 1, further comprising:

receiving a second input from the headset;

accessing the headset profile;

identifying a second control function associated with the second input based on the headset profile; and performing the second control function.

3. The method of claim 1, further comprising:

associating the headset profile with an application on the electronic device by including data indicative of an identifier for the application in the headset profile.

4. The method of claim 1, further comprising:

receiving an identifier from the headset; and associating the headset profile with the headset by including data indicative of the identifier in the headset profile.

5. The method of claim 1, wherein identifying the set of control functions performed by the electronic device comprises:

identifying one or more of a name of an application that is executing on the electronic device or a type of the application; and identifying one or more control functions based on the one or more of the name of the application or the type of the application.

6. The method of claim 1, further comprising:

receiving the input from the headset, wherein the input comprises data indicative of at least one of a sequence of button presses of at least two buttons, or simultaneous button presses of at least two buttons.

7. An electronic device comprising:

a memory to store a headset profile; and a processing device operatively coupled to the memory, the processing device configured to:

present a request for an input from a headset comprising an input mechanism, the input to be associated with performance of a control function;

receive the input from the headset;

associate the input with the control function; and store, in the headset profile, data indicative of an association between the input and the control function.

8. The electronic device of claim 7, wherein the processing device is further to:

present a second request for a second input from the headset, wherein the second input is to be used to cause the electronic device to perform a second control function;

receive the second input from the headset; and store, in the headset profile, data indicative of a second association between the second input and the second control function.

9. The electronic device of claim 7, wherein the processing device is further to:

detect that the headset is connected to the electronic device; and identify the control function when the headset is connected to the electronic device.

10. The electronic device of claim 7, wherein the processing device is further to:

receive a second input from the headset;

access the headset profile;

identify a second control function based on the second input and the headset profile; and perform the second control function.

11. The electronic device of claim 7, wherein the processing device is further to:

associate the headset profile with an application on the electronic device by including data indicative of an identifier for the application in the headset profile.

12. The electronic device of claim 7, wherein the processing device is further to:

receive an identifier from the headset; and associate the headset profile with the headset by including data indicative of the identifier in the headset profile.

13. The electronic device of claim 7, wherein the processing device is further to:

detect that a second headset comprising a second input mechanism is connected to the electronic device;

present a second request for a second input from the second headset, wherein the second input is to be used to cause the electronic device to perform the control function;

receive the second input from the second headset;

store, in a second headset profile in the memory, data indicative of a second association between the second input and the control function; and associate the second headset profile with the second headset.

14. The electronic device of claim 7, wherein the input comprises data indicative of one or more of a single button press, a sequence of button presses, a duration of a button press, or simultaneous button presses.

15. The electronic device of claim 7, wherein the control function comprises one or more of an answer call function, an end call function, a play function, a pause function, a rewind function, a fast forward function, a previous track function or a next track function.

16. The electronic device of claim 7, wherein the processing device is further to:

provide a confirmation of the association between the input and the control function.

17. The electronic device of claim 9, wherein the processing device is to identify the control function by:

identifying an application that is executing on the electronic device; and identifying the control function based on the application.

18. A non-transitory computer-readable medium storing instructions which, when executed, cause a processing device to perform operations comprising:

presenting, by the processing device, a request for an input from a headset comprising an input mechanism, the input to be associated with performance of a control function, wherein the headset is communicatively coupled to the electronic device;

receiving, by the processing device at a first time, the input from the headset;

storing, by the processing device in a headset profile that comprises data indicative of inputs and control actions to be performed when the inputs are received from the headset, data indicative of an association between the input and the control function;

receiving, by the processing device at a second time, the input from the headset;

accessing, by the processing device, the headset profile;

identifying, by the processing device based on the headset profile, the control function associated with the input; and performing, by the processing device, the control function.

19. The non-transitory computer-readable medium of claim 18, wherein the input comprises data indicative of one or more of a single button press, a sequence of button presses, a duration of a button press, or simultaneous button presses.

20. The non-transitory computer-readable medium of claim 18, wherein the operations further comprise:

receiving a second input from the headset;

identifying, based on the headset profile, a second control function associated with the second input; and performing the second control function.

21. The non-transitory computer-readable medium of claim 18, wherein accessing the headset profile comprises:

identifying an application executing on the electronic device; and identifying the headset profile based on the identification of the application.

22. The non-transitory computer-readable medium of claim 18, wherein accessing the headset profile comprises:

detecting that the headset is connected to the electronic device; and identifying the headset profile based on the headset.

23. The non-transitory computer-readable medium of claim 18, wherein the operations further comprise:

detecting that a second headset is connected to electronic device, wherein the second headset comprises another button;

receiving a second input from the second headset;

accessing a second headset profile that comprises second data indicative of additional inputs and additional control actions to be performed when the additional inputs are received from the second headset;

identifying, based on the second headset profile, a second control function associated with the second input; and performing second the control function.

24. The non-transitory computer-readable medium of claim 18, wherein the control function comprises one or more of an answer function, an end call function, a play function, a pause function, a rewind function, a fast forward function, a previous track function, or a next track function.

25. The non-transitory computer-readable medium of claim 18, wherein the operations further comprise:

receiving input identifying the headset profile.

* * * * *